United States Patent [19]

Bursk

[11] 4,006,571

[45] Feb. 8, 1977

[54] MOUNTING ASSEMBLY WITH IMPROVED FASTENER

[75] Inventor: William M. Bursk, Middletown, Ohio

[73] Assignee: Pease Company, Fairfield, Ohio

[22] Filed: Apr. 30, 1976

[21] Appl. No.: 681,793

[52] U.S. Cl. ..... 52/498; 52/397; 52/455; 52/628

[51] Int. Cl.[2] ..... E06B 3/58; E04F 19/06

[58] Field of Search ..... 52/498, 455, 456, 457, 52/458, 397, 476, 585, 753 E, 627, 628, 400, 208, 474, 716, 718; 85/14; 40/152, 154

[56] References Cited

UNITED STATES PATENTS

| | | | |
|---|---|---|---|
| 3,760,543 | 9/1973 | McAllister | 52/397 |
| 3,903,669 | 9/1975 | Pease et al. | 52/455 |

*Primary Examiner*—J. Karl Bell
*Attorney, Agent, or Firm*—Biebel, French & Nauman

[57] ABSTRACT

An assembly for mounting a flat panel of glass or other material in an opening in a door frame. The assembly includes complementary molding sections, each of which has inwardly projecting studs which align with the studs on the opposite molding and are secured by tubular clips which slip over the studs. The clips also include outwardly projecting wings which engage the edges of the panel to support and position it in the door frame opening, and at least one of the wings is disposed at approximately 45° with respect to a plane bisecting the clip. This construction allows the position of the panel to be adjusted by rotating the clips about their longitudinal axes.

9 Claims, 7 Drawing Figures

MOUNTING ASSEMBLY WITH IMPROVED FASTENER

BACKGROUND OF THE INVENTION

Assemblies for mounting panels of glass or other material in an opening in a door frame are disclosed in U.S. Pat. No. 3,760,543 and 3,903,669, the latter being assigned to the assignee of the present application. In both patents a pair of molding members are used, each of which is provided with spaced sockets around its inner surface to receive connecting pins that extend between the molding members.

Although the pin and socket connectors may also support the panel mounted in the door frame, their primary function is to interconnect the molding members, and generally some provision is made for separate support for the panel. Regardless of this, the molded connectors are of course fixed, and even if they are relied upon for panel support there is no provision for adjusting the position of the panels in the door frame opening.

Additionally, some difficulty may be experienced with pin and socket type connectors as a result of temperature induced dimensional variations, which can result in damage to the connectors and the door assembly.

SUMMARY OF THE INVENTION

The present invention provides a mounting assembly for supporting a flat panel of glass or other material in an opening in a door frame which includes a pair of complementary molding members secured in place by means of aligned studs projecting inwardly and interconnected by means of tubular clips which also include portions for supporting the panel and providing some degree of adjustability of the panel position in the frame.

Specifically, the inwardly projecting studs of the complementary molding members are received in tubular clips which may be constructed of spring steel and have inwardly projecting teeth which bite into the studs received therein to provide a secure fastening.

Additionally, a center stop is provided so that the frame can be assembled conveniently by pushing the clips onto each of the studs of one molding member until the ends of its studs engage the center stop, placing the panels in place on the molding member and then placing the second molding member in position with its studs inserted into the open ends of the clips.

Each of the clips includes outwardly projecting wings designed to engage and support edges of the panel. At least one of the wings is disposed at an angle to a plane bisecting the clip so that the distance from the outer surface of the wing to the longitudinal axis of the stud on which the clip is mounted varies along the surface of the wing. In this way by rotating the clip about the stud on which it is received some adjustment of the position of the panel can be attained.

These and other features and advantages will become more apparent from the following description.

DESCRIPTION OF THE PREFERRED EMBODIMENTS

Figure 1:
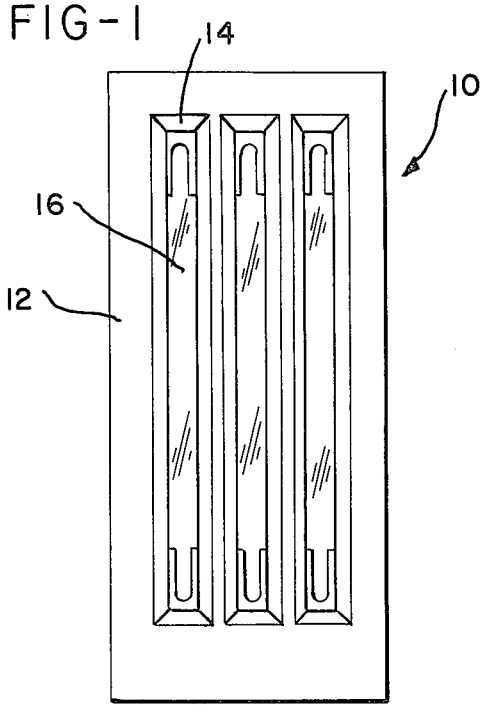
FIG. 1 is an elevational view of a door incorporating a plurality of panels held in the door opening by molding members.

As seen in FIG. 1 of the drawings, a typical door may include an outer frame 12 having a series of openings formed therein, each of which receives a molding 14 supporting a panel 16 of glass or other material. As described in detail in the above noted U.S. Pat. No. 3,903,669, each of the complementary molding members have an inner rim which engages the panel about its outer edge, an outer rim which engages a portion of the door frame about an opening in the frame, and an intermediate portion interconnecting the inner and outer rims. Thus, when the two, complementary molding members are fastened together the panels 16 are secured in the door frame opening.

Figure 2:
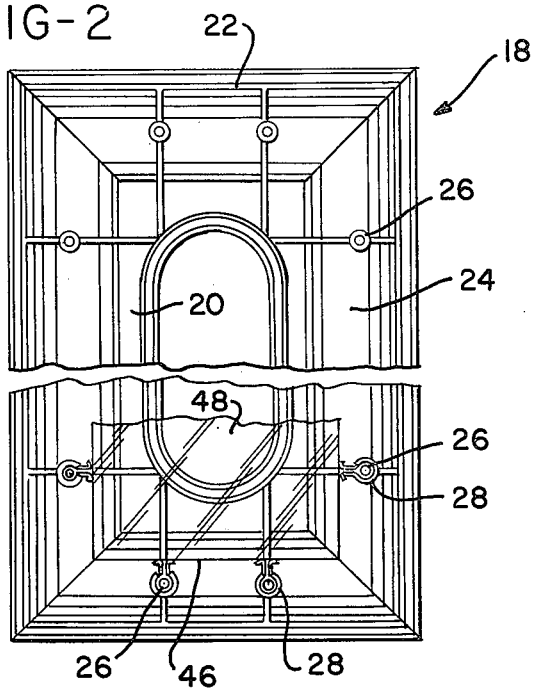
FIG. 2 is a plan view, with portions broken away, of one complementary molding member showing some of the clips of the present invention installed thereon and a portion of a panel supported thereby.
Figure 3:
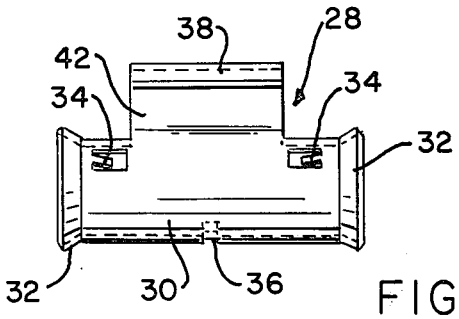
FIG. 3 is an enlarged side view of a clip in accordance with the present invention.

Turning next to FIG. 2 of the drawings, it will be seen that one of the two complementary molding members is shown at 18, including an inner, panel engaging rim 20, an outer, frame engaging rim 22 and an intermediate portion 24 carrying a series of studs 26. Each of the studs 26 in the assembled construction will be received in one end of a tubular clip 28 best seen in FIGS. 3 through 6 of the drawings.

The clips 28 each include a cylindrical portion 30 terminating in flared opposite ends 32. Teeth 34 project inwardly of the clip and towards its center while a stop or positioning means 36 is depressed from a central portion of the clip.

Wings 38 and 40 project outwardly of the clip and are joined to the portion 30 by means of stems 42 and 44. The wings 38 and 40 are adapted, as seen in FIGS. 2 and 4 through 7 of the drawings, to engage an edge 46 of a panel 48 mounted in the door opening.

Figure 4:
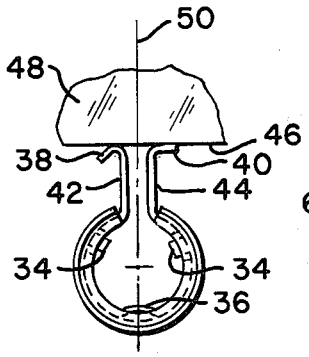
FIG. 4 is an end view of the clip of FIG. 3 showing it in supporting relationship to a panel.
Figure 5:
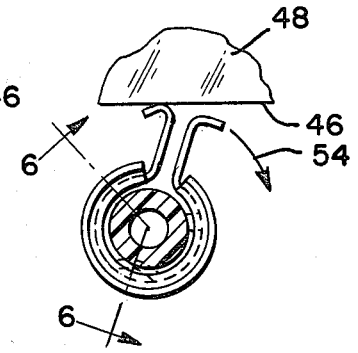
FIG. 5 is a view similar to FIG. 4 but showing the adjustable feature of the clip of the present invention.

It will be particularly noted from FIGS. 4 and 5 of the drawings that at least one wing is disposed at an angle to a plane 50 bisecting the clip 28. As shown, wing 38 is disposed at approximately 45° to plane 50 although this can obviously be varied somewhat. The other wing, 40, may be similarly positioned, although for ease of manufacturing it may be preferred to dispose this wing, as shown, substantially perpendicular to plane 50.

Figure 6:
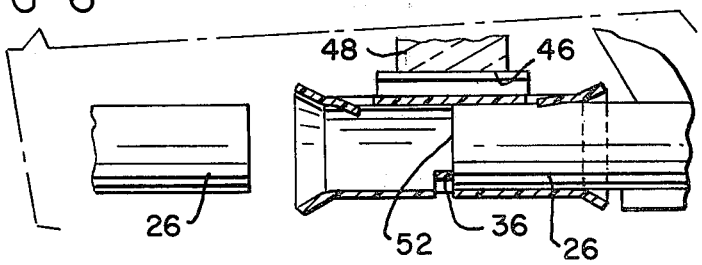
FIG. 6 is a view taken along line 6—6 of FIG. 5.

With the above construction it will be seen that one of the molding members 18 can be positioned in a door frame opening with its outer rim 22 engaging an annular surface area of the frame surrounding the opening and clips 28 slipped onto its studs 26 until the ends 52 of the studs engage the stops 36, as seen in FIG. 6 of the drawings.

Thereafter the panel 48 can be laid in place and the clips 28 rotated about the axis of the studs on which they are mounted, as indicated by the arrow 52 in FIG. 5 of the drawings, to position the panel as desired in the door frame opening.

Thus, with a clip disposed as shown in FIG. 4 of the drawings the adjacent edge of a panel will be positioned at a certain distance from the longitudinal axis of the stud on which the clip is received. As the clip is rotated clockwise as seen in FIG. 5 this distance decreases.

With the wing 40 disposed as shown, substantially perpendicular to the plane 50, rotating the clip is a counterclockwise position as shown in FIG. 4 will cause the distance between the edge of the panel and the longitudinal axis of the clip to increase.

Of course, if desired, the clip could be rotated in excess of 90° from the position shown in FIG. 4 to allow the edge of the panel to engage directly on the cylindrical portion of the clip.

Figure 7:
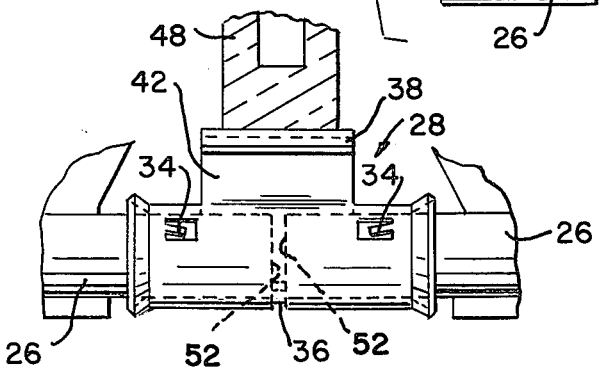
FIG. 7 is a view of a portion of the assembly showing the molding member clip in supporting relationship to a panel.

After the panel is positioned as desired the opposing studs 26 of the complementary molding member are inserted in the clips 28 until ends 52 engage the stops 36, as seen in FIG. 7 of the drawings, locking the two molding members in place and mounting the panel 44 in the door frame opening.

From the above, it will be apparent that the present invention provides a mounting assembly which includes a molding member clip which not only provides superior fastening for securing the molding members in position in a door frame opening, but also supports and permits adjustment of the position of a panel mounted in the door frame opening.

While the form of apparatus herein described constitutes a preferred embodiment of the invention, it is to be understood that the invention is not limited to this precise form of apparatus, and that changes may be made therein without departing from the scope of the invention.

What is claimed is:

1. In a mounting assembly for supporting a panel in a receiving opening in a frame, including a pair of complementary molding members each having an outer rim sized to seat on an annular surface area of the frame surrounding the opening in which a panel is to be supported, an inner rim sized to seat on an annular surface area adjacent the periphery of a panel supported in the opening, and an intermediate portion interconnecting said inner and outer rims, the improvement comprising:

opposed, aligned studs projecting from said molding members towards each other, tubular clip means interconnecting said opposed aligned studs, said tubular clip means including cylindrical portions receiving said opposed, aligned studs, and wing portions projecting from said cylindrical portions of said clip means for supporting an edge of a panel engaged by said inner rims of said molding members.

2. The assembly of claim 1 further comprising:

teeth means projecting inwardly of said cylindrical portions in engagement with said studs.

3. The assembly of claim 2 wherein:

said teeth means project inwardly toward the center of said clip to prevent withdrawal of said studs from said clips.

4. The assembly of claim 1 further comprising:

flared end portions on said cylindrical portions of said clip means for facilitating entry of said studs into said clips.

5. The assembly of claim 1 further comprising:

stem portions extending from said cylindrical portions of said clip means and carrying said wing portions thereon to space said wing portions from said cylindrical portions.

6. The assembly of claim 1 wherein:

at least one of said wing portions is angularly disposed with respect to a plane bisecting said clip means.

7. The assembly of claim 6 wherein:

at least one of said wing portions is substantially perpendicularly disposed with respect to said plane bisecting said clip.

8. The assembly of claim 1 further comprising:

positioning means projecting inwardly of said cylindrical portions of said clip means substantially medially of the length of said cylindrical portions and adapted to engage the ends of opposed, aligned studs received in said cylindrical portions of said clip means.

9.

In a mounting assembly including a frame having an opening formed therein, a substantially flat panel received in said opening, a pair of complementary molding members mounting said panel in said opening, each of said molding members including an outer rim seating on an annular surface area of said frame surrounding said opening, an inner rim seating on an annular surface area of said panel adjacent the periphery thereof and an intermediate portion interconnecting said inner and outer rims, the improvement comprising:

a plurality of studs formed integrally with and projecting from each of said molding members with the studs on said molding members being disposed in opposed, aligned relationship with each other, a plurality of rolled, sheet metal clips of substantially tubular configuration, each of said clips including a cylindrically shaped main body portion received over opposed aligned studs with opposite ends of said main body portion being flared to receive said studs, teeth projecting inwardly of said main body portion towards the center thereof for retarding removal of said studs from said main body portion, a portion of said main body portion adjacent the center thereof being deformed inwardly thereof and engaging the end of at least one of the studs received in said main body portion, a pair of flat stems projecting outwardly of said main body portion, each of said flat stems terminating in an outwardly bent wing, one of said wings being angularly disposed with respect to a plane bisecting said clip, the other of said wings being substantially perpendicularly disposed with respect to said plane, and at least one of said wings being in engagement with an edge of said panel.

* * * * *